US011578596B2

(12) United States Patent
Camargo et al.

(10) Patent No.: US 11,578,596 B2
(45) Date of Patent: Feb. 14, 2023

(54) CONSTRAINED NATURAL FRACTURE PARAMETER HYDROCARBON RESERVOIR DEVELOPMENT

(71) Applicant: Saudi Arabian Oil Company, Dhahran (SA)

(72) Inventors: Otto Meza Camargo, Dhahran (SA); Karla Olvera Carranza, Dhahran (SA); Cesar Pardo, Dhahran (SA); Marko Maucec, Dhahran (SA); Olugbenga Olukoko, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/370,307

(22) Filed: Jul. 8, 2021

(65) Prior Publication Data

US 2023/0012429 A1 Jan. 12, 2023

(51) Int. Cl.

| | |
|---|---|
| ***E21B 49/00*** | (2006.01) |
| ***E21B 49/08*** | (2006.01) |
| ***E21B 43/26*** | (2006.01) |
| ***E21B 47/06*** | (2012.01) |
| ***E21B 47/10*** | (2012.01) |
| ***E21B 47/002*** | (2012.01) |

(52) U.S. Cl.

CPC ..... *E21B 49/0875* (2020.05); *E21B 43/26* (2013.01); *E21B 47/0025* (2020.05); *E21B 47/06* (2013.01); *E21B 47/10* (2013.01); *E21B 49/006* (2013.01); *E21B 2200/20* (2020.05); *E21B 2200/22* (2020.05)

(58) Field of Classification Search

CPC ..... E21B 2200/20

See application file for complete search history.

(56) References Cited

U.S. PATENT DOCUMENTS

| | | | |
|---|---|---|---|
| 6,246,963 | B1 | 6/2001 | Cross et al. |
| 6,826,486 | B1 | 11/2004 | Malinverno |
| 7,440,876 | B2 | 10/2008 | Geehan et al. |
| 8,392,165 | B2 | 3/2013 | Craig et al. |
| 8,521,494 | B2 | 8/2013 | Narr et al. |
| 9,703,006 | B2 | 7/2017 | Stern et al. |
| 10,241,231 | B2 | 3/2019 | Lange et al. |

(Continued)

FOREIGN PATENT DOCUMENTS

| | | | |
|---|---|---|---|
| CN | 107290782 | A | 10/2017 |

OTHER PUBLICATIONS

Barton, Colleen A. et al.; "Fluid flow along potentially active faults in crystalline rock" Geology, Aug. 1995; v. 23; No. 8; pp. 683-686.

(Continued)

*Primary Examiner* — Kenneth L Thompson

(74) *Attorney, Agent, or Firm* — Bracewell LLP; Constance G. Rhebergen; Brian H. Tompkins

(57) ABSTRACT

Systems and methods for developing hydrocarbon reservoirs based on constrained natural fracture parameters. A natural fracture modeling is generated for a reservoir, an initial set of fracture model parameters is determined, and a fracture model optimization is conducted to determine an optimized set of fracture model parameters. The optimized set of fracture model parameters are used as a basis for modeling the reservoir, and the modeling is used to generate a simulation of the reservoir.

21 Claims, 6 Drawing Sheets

(56) References Cited

U.S. PATENT DOCUMENTS

| | | | | |
|---|---|---|---|---|
| 10,417,561 | B2 | 9/2019 | Mohaghegh | |
| 10,578,766 | B2 | 3/2020 | Abou-Sayed et al. | |
| 10,607,043 | B2 | 3/2020 | Camargo et al. | |
| 10,657,441 | B2 | 5/2020 | Dursun et al. | |
| 10,816,686 | B2 | 10/2020 | Den Boer et al. | |
| 2020/0095858 | A1 | 3/2020 | Bouaouaja et al. | |
| 2020/0292722 | A1 | 9/2020 | Maucec et al. | |
| 2021/0003005 | A1* | 1/2021 | Zhu | G01N 3/08 |
| 2021/0079779 | A1* | 3/2021 | Valiveti | G01V 1/282 |
| 2021/0096277 | A1* | 4/2021 | Zaki | E21B 43/00 |
| 2021/0124086 | A1* | 4/2021 | Dontsov | G06F 30/20 |
| 2021/0222518 | A1* | 7/2021 | Bardy | E21B 43/26 |
| 2021/0231835 | A1* | 7/2021 | Ruhle | E21B 47/06 |
| 2021/0232868 | A1* | 7/2021 | Gong | G06K 9/6262 |
| 2021/0256183 | A1* | 8/2021 | Zhang | G01V 99/005 |
| 2021/0350208 | A1* | 11/2021 | Wang | G06N 5/003 |

OTHER PUBLICATIONS

De Pater, C.J. et al.; "Hydraulic Fracture Height Growth: Pseudo-3D vs. Full 3D Modeling" (abstract only) SPE International Hydraulic Fracturing Technology Conference & Exhibition, Oman, Oct. 2018; pp. 1-5.

Emerson; "Kine3D: Optimize geological interpretation through structural restoration and balancing" May 11, 2021; pp. 1-3.

Emerson; "Kine3D: Structural Restoration and Balancing" (2018); pp. 1-2.

Herwanger, J. et al.; "Seismic Geomechanics: How to Build and Calibrate Geomechanical Models using 3D and 4D Seismic Data" European Association of Geoscientists & Engineers (EAGE), 2011; pp. 1-174.

Lee, Sanghyun et al.; "Optimal design of hydraulic fracturing in porous media using the phase field fracture model coupled with genetic algorithm" Computational Geosciences, Springer, Jan. 22, 2018; pp. 1-17.

Lei, Qinghua et al.; "The use of discrete fracture networks for modelling coupled geomechanical and hydrological behaviour of fractured rocks" Computers and Geotechnics 85 (2017); pp. 151-176.

Mauldon, M. et al.; "A Multi-Dimensional System of Fracture Abundance Measures" Geological Society of America Annual Meeting, Reno NV, Nov. 2000; pp. 1-12.

Min, Ki-Bok et al.; "Stress-Dependent Permeability of Fractured Rock Masses: A Numerical Study" International Journal of Rock Mechanics and Mining Sciences, vol. 41, Issue 7, 2004; pp. 1191-1210.

Niven, Eric B. et al.; "Relating Different Measures of Fracture Intensity" Paper 103, CCG Annual Report 12, 2020 pp. 103-1-103-4.

Petrowiki; "Rock type influence on permeability" available as of May 3, 2021 at: https://petrowiki.spe.org/Rock_type_influence_on_permeability; pp. 1-10.

Quosay, Awad Ahmed et al.; "Hydraulic fracturing: New uncertainty based modelling approach for process design using Monte Carlo simulation technique" China University of Mining and Technology, Jul. 29, 2020; pp. 1-11.

Tiab, Djebbar et al.; "Naturally Fractured Reservoirs" Petrophysics (Fourth Edition), 2016; pp. 1-13.

Wikipedia; "Cluster analysis" available as of May 3, 2021 at: https://en.wikipedia.org/wiki/Cluster_analysis; pp. 1-21.

Wikipedia; "Genetic algorithm" available as of May 3, 2021 at: https://en.wikipedia.org/wiki/Genetic_algorithm; pp. 1-18.

Wikipedia; "Petrel (reservoir software)" available as of Apr. 30, 2021 at: https://en.wikipedia.org/wiki/Petrel_(reservoir_software); pp. 1-2.

Wyllie, Duncan C. et al.; "Rock Strength Properties and Their Measurement" Landslides: Investigation and Mitigation—Chapter 14 (1996); pp. 372-390.

Zoback, Mark D.; "Chapter 11: Critically stressed faults and fluid flow" Reservoir Geomechanics, Cambridge University Press, New York, 2007, pp. 1-21.

* cited by examiner

400

| Realization Number | Variogram Major (Max) | Variogram Minor (Min) | Variogram Vertical | Fracture Length | Aspect Ratio | Concentration | Intensity | Permeability Factor | Friction Angle | Normalize |
|---|---|---|---|---|---|---|---|---|---|---|
| 265 | 1255.23 | 1042.414624 | 34285274819 | 4335.557115 | 117.1901608 | **41.41636402** | 1359.398175 | **5.649601733** | 30.42822047 | 38.43745231 |
| 279 | 1462.32 | 834.7422712 | **11.55491806** | 4068.092898 | **102.1018097** | 63.96923734 | 1250.166326 | 5.745185705 | **29.92** | 37.33390301 |
| 280 | 1485.96 | **1187.13** | 36.55873287 | 4186.962493 | 132.4433119 | 56.34907071 | 1241.45024 | 6.710608234 | 30.28313547 | 36.34876553 |
| 283 | 1337.27 | **809.8025452** | 42.13446455 | **3688.290048** | 128.5924863 | 90.64302499 | 1150.175481 | 5.827707755 | 30.09593493 | 35.5732902 |
| 290 | **1245.05** | 1054.75631 | 14.98825037 | 3766.05121 | 112.5977355 | 78.19055757 | 1278.804895 | **7.04** | 30.41741691 | 35.48142949 |
| 293 | 1475.90 | 1066.646321 | 31.48350475 | 3910.953093 | 131.4325388 | 54.66780602 | 1258.931242 | 6.129840999 | **30.44604328** | 35.6245613 |
| 295 | 1248.93 | 955.1316874 | 21.87780389 | 4487.752922 | 125.7744072 | 65.29374065 | 1281.344035 | 6.016495254 | 30.24449904 | 34.86770226 |
| 299 | 1434.36 | 1070.88229 | 28.88180181 | 4397.936949 | 109.1589099 | 76.27643666 | **1003.100681** | 6.01863155 | 30.31359294 | 34.27411725 |
| 305 | **1587.32** | 824.9397259 | 12.77260659 | 4074.135563 | 140.1065096 | **98.96** | 1155.363628 | 6.814004944 | 30.10106204 | 38.69411298 |
| 310 | 1533.38 | 970.7449568 | 27.42454299 | 4235.670034 | 115.4890591 | 93.28562273 | 1313.327433 | 6.239890744 | 30.32238227 | **39.62** |
| 314 | 1312.36 | 1064.412366 | 16.41041292 | 3813.904233 | **148.67** | 97.86370434 | **1367.58** | 6.405911435 | 29.97270119 | 36.31733146 |
| 315 | 1403.13 | 962.8833888 | 35.5363628 | **4597.77** | 104.7990356 | 76.68660543 | 1268.449995 | 5.820566424 | 30.36468093 | 31.63609729 |
| 312 | 1247.39 | 968.7917722 | **44.11** | 4168.80398 | 131.8005921 | 78.16278573 | 1325.327311 | 5.687810907 | 30.33806879 | **30.34150212** |

FIG. 4

500

| | Variogram Major (Max) | Variogram Minor (Min) | Variogram Vertical | Fracture Length | Aspect Ratio | Concentration | Intensity | Permeability Factor | Friction Angle | Normalize |
|---|---|---|---|---|---|---|---|---|---|---|
| Range Minimum | 1245.05 | 809.80 | 11.55 | 3688.29 | 102.10 | 41.42 | 1003.10 | 5.65 | 30.45 | 30.34 |
| Range Maximum | 1597.32 | 1187.13 | 44.11 | 4597.77 | 98.96 | 98.96 | 1367.58 | 7.04 | 29.92 | 39.62 |

FIG. 5

CONSTRAINED NATURAL FRACTURE PARAMETER HYDROCARBON RESERVOIR DEVELOPMENT

FIELD

Embodiments relate generally to developing hydrocarbon reservoirs, and more particularly to modeling and developing hydrocarbon reservoirs based on natural fracture constraints.

BACKGROUND

A well typically includes a wellbore (or "borehole") that is drilled into the earth to provide access to a geologic formation that resides below the earth's surface (or "subsurface formation"). A well may facilitate the extraction of natural resources, such as hydrocarbons and water, from a subsurface formation, facilitate the injection of substances into the subsurface formation, or facilitate the evaluation and monitoring of the subsurface formation. In the petroleum industry, hydrocarbon wells are often drilled to extract (or "produce") hydrocarbons, such as oil and gas, from subsurface formations.

Developing a hydrocarbon well for production typically involves a drilling stage, a completion stage and a production stage. The drilling stage involves drilling a wellbore into a portion of the formation that is expected to contain hydrocarbons (often referred to as a "hydrocarbon reservoir" or a "reservoir"). The completion stage involves operations for making the well ready to produce hydrocarbons, such as installing casing, installing production tubing, installing valves for regulating production flow, or pumping substances into the well to fracture, clean or otherwise prepare the well to produce hydrocarbons. The production stage involves producing hydrocarbons from the reservoir by way of the well. During the production stage, the drilling rig is typically replaced with production valves that are operable to regulate production flow rate and pressure, and to route production to a distribution network of midstream facilities, such as tanks, pipelines or vehicles that transport production from the well to downstream facilities, such as refineries or export terminals.

Developing a hydrocarbon well normally involves overcoming a variety of challenges in the drilling, completion and production stages. For example, during production operations, a well operator typically attempts to regulate production from wells to optimize the amount of production from the reservoir. The can include regulating well flow rates and pressures based on characteristics of the reservoir and wells in the reservoir. In some instances, production operations are conducted based on simulations that predict movement of fluids within a reservoir under different sets of operating conditions. For example, a reservoir developer may generate models that incorporate characteristics of a reservoir, such as estimates of formation rock properties across the reservoir and the location and operating parameters of wells in the reservoir, use the models to generate a simulations that predict how production fluid and water will move within the formation over time under different conditions, and operate wells in the reservoir based on the predictions provided by the simulations. In many cases, simulations are updated overtime and corresponding adjustments are made in an effort to optimize the extraction of hydrocarbons from the reservoir.

SUMMARY

Simulations can be an important aspect of developing a reservoir. For example, simulations of different operational scenarios may reveal an optimal solution for extracting hydrocarbons from the reservoir, and an operator may create and execute a field development plan (FDP) in accordance with the solution. In many instances, simulations are generated periodically based on updated information, such as updated well measurements (e.g., updated well logs) and updated models (e.g., updated reservoir models), and the updated simulations are used to adjust an FDP in an effort to produce the reservoir in an effective and efficient manner.

Unfortunately, reservoir characteristics and performance can be difficult to model, which can lead to inaccurate simulations. Although some characteristics can be measured directly (e.g., by way of core assessments, well logs and seismic logs), these types of measurements may be limited to certain locations within the reservoir (e.g., in or around a wellbore) or may provide a limited amount of information. As a result, many "unknown" characteristics are estimated, for example, by way of interpretation and additional modeling based on well performance test and assessment (e.g., pressure transient analysis (PTA) and production logs tests (PLTs)).

Reservoir permeability—a measure of the ability of reservoir rock to transmit fluids—is typically an important aspect of modeling and simulating a hydrocarbon reservoir, but permeability can be difficult to characterize. Permeability of reservoir rock can be attributable to a number of factors, including fractures in the formation rock that provide paths for the communication of fluids. Natural fractures present in subsurface formations are discontinuities formed as a result of movements and deformations within subsurface rock over time, and they often continue to evolve as a result of seismic events, such as tremors or movements in the earth's crust. Natural fractures are different in origin form fractures induced in earth formations from external stimulations, such as hydraulic fractures generated by hydraulic fracturing operations (or "fracking"). Natural fracture identification, characterization and prediction is one of the more challenging problems in reservoir assessment. As a result, many models and simulations suffer due to an inability to accurately account for the location, size and behavior of natural fractures.

Provided are systems and methods for developing hydrocarbon reservoirs based on constrained natural fracture parameters. In some embodiments, a natural fracture modeling is generated for a reservoir, an initial set of fracture model parameters is determined (e.g., including initial ranges for certain fracture model parameters), and a fracture model "optimization" is conducted (e.g., including a parameterization and calibration employing Genetic algorithm) to determine an "optimized" set of fracture model parameters (e.g., including constrained ranges for the fracture model parameters). In some embodiments the optimized set of fracture model parameters is used as a basis for modeling the reservoir (e.g., in a simultaneous closed loop inversion of the natural fracture modeling of the reservoir), and the modeling is used to generate a simulation of the reservoir. Such a simulation may, for example, be used as a basis for developing the reservoir.

Provided is a method of developing a hydrocarbon reservoir, the method including: determining a natural fracture model of the hydrocarbon reservoir; determining initial ranges for the plurality of fracture modeling parameters including: determining, based on geomechanical modeling of the hydrocarbon reservoir, initial ranges of geomechanical parameters of the hydrocarbon reservoir including: an initial range of an in-situ stress parameter for the hydrocarbon reservoir; and an initial range of a friction angle parameter for the hydrocarbon reservoir; determining, based on a borehole image (BHI) log of a wellbore extending into the hydrocarbon reservoir, initial ranges of fracture distribution parameters of the hydrocarbon reservoir including: an initial range of a fracture intensity parameter; an initial range of a fracture length parameter; an initial range of a fracture aspect ratio parameter; and an initial range of a fracture concentration parameter; determining an initial range of a fracture permeability factor for the hydrocarbon reservoir; determining a geological modeling of the hydrocarbon reservoir, the geological modeling of the hydrocarbon reservoir adapted to generate, for a given set of fracture modeling parameters, a modeled flow capacity; determining, based on observed well production test data, an observed well flow capacity; conducting a natural fracture model optimization including: for each of different sets of fracture model parameters falling within the initial fracture model parameter ranges, applying the set of fracture model parameters to the geological modeling of the hydrocarbon reservoir to generate a corresponding modeled flow capacity; and conducting a minimization operation to determine constrained fracture model parameters ranges, the minimization operation including comparison of the modeled flow capacities to the observed well flow capacity and the constrained fracture model parameter ranges including a constrained range defined by a maximum and minimum value for each fracture modeling parameter of the plurality of fracture modeling parameters; conducting, using the constrained fracture model parameters ranges and the natural fracture model, a simulation of the hydrocarbon reservoir to generate a reservoir simulation including predicted of performance of the hydrocarbon reservoir; determining, based on the reservoir simulation, operational parameters for a well extending into the hydrocarbon reservoir; and developing, in response to determining the operational parameters, the well in accordance with the operational parameters for the well.

In some embodiments, the minimization operation includes minimization of differences between the observed well flow capacity and the modeled flow capacity, and where the minimization operation includes application of a genetic algorithm to identify a set of optimal fracture model parameters, where the constrained fracture model parameters ranges include maximum and minimum values of the fracture model parameters of the set of optimal fracture model parameters. In certain embodiments, the simulation includes a simultaneous closed-loop inversion in dual porosity dual permeability numerical simulation. In some embodiments, the natural fracture model including a plurality of fracture modeling parameters characterizing naturally occurring fractures of the hydrocarbon reservoir. In certain embodiments, the modeled flow capacity including a sum of the following: a flow capacity for fractures in the hydrocarbon reservoir; a flow capacity for high permeability streaks (HPS) in the hydrocarbon reservoir; and a flow capacity for the rock matrix in the hydrocarbon reservoir. In some embodiments, the observed well production test data including production log test (PLT) data and pressure transient analysis (PTA) data. In certain embodiments, the operational parameters for the well include a well location and trajectory, and developing the well includes drilling the well at the location and with the trajectory, or where the operational parameters for the well include a production pressure or production rate, and developing the well includes operating the well at the production pressure or the production rate.

Provided in some embodiments is a hydrocarbon well system including: a well system adapted to operate the hydrocarbon well; and a well control system adapted to perform the following operations: determining a natural fracture model of the hydrocarbon reservoir; determining initial ranges for the plurality of fracture modeling parameters including: determining, based on geomechanical modeling of the hydrocarbon reservoir, initial ranges of geomechanical parameters of the hydrocarbon reservoir including: an initial range of an in-situ stress parameter for the hydrocarbon reservoir; and an initial range of a friction angle parameter for the hydrocarbon reservoir; determining, based on a borehole image (BHI) log of a wellbore extending into the hydrocarbon reservoir, initial ranges of fracture distribution parameters of the hydrocarbon reservoir including: an initial range of a fracture intensity parameter; an initial range of a fracture length parameter; an initial range of a fracture aspect ratio parameter; and an initial range of a fracture concentration parameter; determining an initial range of a fracture permeability factor for the hydrocarbon reservoir; determining a geological modeling of the hydrocarbon reservoir, the geological modeling of the hydrocarbon reservoir adapted to generate, for a given set of fracture modeling parameters, a modeled flow capacity; determining, based on observed well production test data, an observed well flow capacity; conducting a natural fracture model optimization including: for each of different sets of fracture model parameters falling within the initial fracture model parameter ranges, applying the set of fracture model parameters to the geological modeling of the hydrocarbon reservoir to generate a corresponding modeled flow capacity; and conducting a minimization operation to determine constrained fracture model parameters ranges, the minimization operation including comparison of the modeled flow capacities to the observed well flow capacity and the constrained fracture model parameter ranges including a constrained range defined by a maximum and minimum value for each fracture modeling parameter of the plurality of fracture modeling parameters; conducting, using the constrained fracture model parameters ranges and the natural fracture model, a simulation of the hydrocarbon reservoir to generate a reservoir simulation including predicted of performance of the hydrocarbon reservoir; and determining, based on the reservoir simulation, operational parameters for a well extending into the hydrocarbon reservoir; controlling, in response to determining the operational parameters, the well system to develop the well in accordance with the operational parameters for the well.

In some embodiments, the minimization operation includes minimization of differences between the observed well flow capacity and the modeled flow capacity, and where the minimization operation includes application of a genetic algorithm to identify a set of optimal fracture model parameters, where the constrained fracture model parameters ranges include maximum and minimum values of the fracture model parameters of the set of optimal fracture model parameters. In some embodiments, the simulation includes a simultaneous closed-loop inversion in dual porosity dual permeability numerical simulation. In certain embodiments, the natural fracture model including a plurality of fracture modeling parameters characterizing naturally occurring fractures of the hydrocarbon reservoir. In some embodiments, the modeled flow capacity including a sum of the following: a flow capacity for fractures in the hydrocarbon reservoir; a flow capacity for high permeability streaks (HPS) in the hydrocarbon reservoir; and a flow capacity for the rock matrix in the hydrocarbon reservoir. In certain embodiments, the observed well production test data including production log test (PLT) data and pressure transient analysis (PTA) data. In some embodiments, the operational parameters for the well include a well location and trajectory, and developing the well includes drilling the well at the location and with the trajectory, or where the operational parameters for the well include a production pressure or production rate, and developing the well includes operating the well at the production pressure or the production rate.

Provided in some embodiments is a non-transitory computer readable storage medium including program instructions stored thereon that are executable by a processor to perform the following operations for developing a hydrocarbon reservoir: determining a natural fracture model of the hydrocarbon reservoir; determining initial ranges for the plurality of fracture modeling parameters including: determining, based on geomechanical modeling of the hydrocarbon reservoir, initial ranges of geomechanical parameters of the hydrocarbon reservoir including: an initial range of an in-situ stress parameter for the hydrocarbon reservoir; and an initial range of a friction angle parameter for the hydrocarbon reservoir; determining, based on a borehole image (BHI) log of a wellbore extending into the hydrocarbon reservoir, initial ranges of fracture distribution parameters of the hydrocarbon reservoir including: an initial range of a fracture intensity parameter; an initial range of a fracture length parameter; an initial range of a fracture aspect ratio parameter; and an initial range of a fracture concentration parameter; determining an initial range of a fracture permeability factor for the hydrocarbon reservoir; determining a geological modeling of the hydrocarbon reservoir, the geological modeling of the hydrocarbon reservoir adapted to generate, for a given set of fracture modeling parameters, a modeled flow capacity; determining, based on observed well production test data, an observed well flow capacity; conducting a natural fracture model optimization including: for each of different sets of fracture model parameters falling within the initial fracture model parameter ranges, applying the set of fracture model parameters to the geological modeling of the hydrocarbon reservoir to generate a corresponding modeled flow capacity; and conducting a minimization operation to determine constrained fracture model parameters ranges, the minimization operation including comparison of the modeled flow capacities to the observed well flow capacity and the constrained fracture model parameter ranges including a constrained range defined by a maximum and minimum value for each fracture modeling parameter of the plurality of fracture modeling parameters; conducting, using the constrained fracture model parameters ranges and the natural fracture model, a simulation of the hydrocarbon reservoir to generate a reservoir simulation including predicted of performance of the hydrocarbon reservoir; and determining, based on the reservoir simulation, operational parameters for a well extending into the hydrocarbon reservoir; controlling, in response to determining the operational parameters, a well system to develop the well in accordance with the operational parameters for the well.

In some embodiments, the minimization operation includes minimization of differences between the observed well flow capacity and the modeled flow capacity, and where the minimization operation includes application of a genetic algorithm to identify a set of optimal fracture model parameters, where the constrained fracture model parameters ranges include maximum and minimum values of the fracture model parameters of the set of optimal fracture model parameters. In certain embodiments, the simulation includes a simultaneous closed-loop inversion in dual porosity dual permeability numerical simulation. In some embodiments, the natural fracture model including a plurality of fracture modeling parameters characterizing naturally occurring fractures of the hydrocarbon reservoir. In certain embodiments, the modeled flow capacity including a sum of the following: a flow capacity for fractures in the hydrocarbon reservoir; a flow capacity for high permeability streaks (HPS) in the hydrocarbon reservoir; and a flow capacity for the rock matrix in the hydrocarbon reservoir. In some embodiments, the observed well production test data including production log test (PLT) data and pressure transient analysis (PTA) data. In certain embodiments, the operational parameters for the well include a well location and trajectory, and developing the well includes drilling the well at the location and with the trajectory, or where the operational parameters for the well include a production pressure or production rate, and developing the well includes operating the well at the production pressure or the production rate.

BRIEF DESCRIPTION OF THE DRAWINGS

FIG. 4 is a diagram that illustrates example parameter sets in accordance with one or more embodiments.

FIG. 5 is a diagram that illustrates example constrained parameter ranges in accordance with one or more embodiments.

Figure 1:
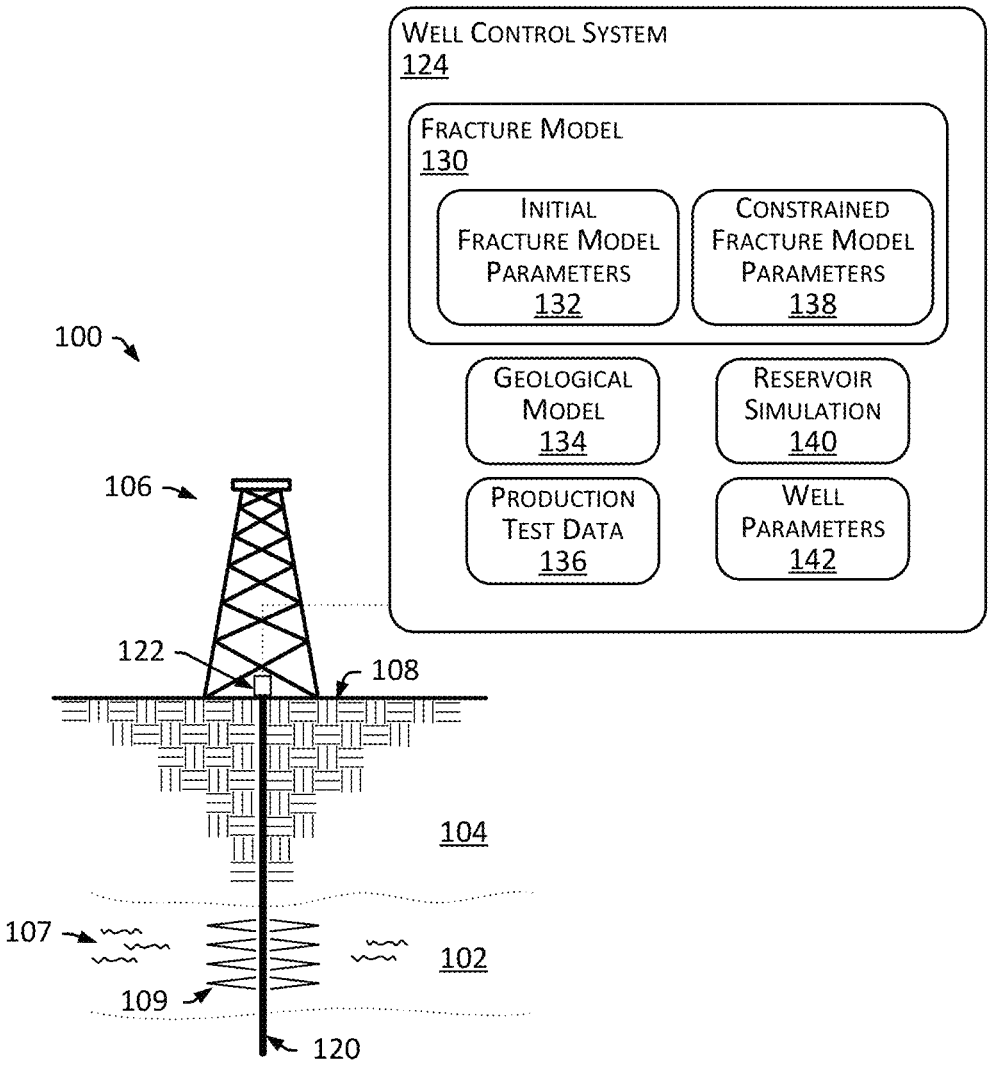
FIG. 1 is diagram that illustrates a well environment in accordance with one or more embodiments.

While this disclosure is susceptible to various modifications and alternative forms, specific embodiments are shown by way of example in the drawings and will be described in detail. The drawings may not be to scale. It should be understood that the drawings and the detailed descriptions are not intended to limit the disclosure to the particular form disclosed, but are intended to disclose modifications, equivalents, and alternatives falling within the scope of the present disclosure as defined by the claims.

DETAILED DESCRIPTION

Described are embodiments of novel systems and method for developing hydrocarbon reservoirs based on constrained natural fracture parameters. In some embodiments, a natural fracture modeling is generated for a reservoir, an initial set of fracture model parameters is determined (e.g., including initial ranges for certain fracture model parameters), and a fracture model "optimization" is conducted (e.g., including a parameterization and calibration employing Genetic algorithm) to determine an "optimized" set of fracture model parameters (e.g., including constrained ranges for the fracture model parameters). In some embodiments the optimized set of fracture model parameters is used as a basis for modeling the reservoir (e.g., in a simultaneous closed loop inversion of the natural fracture modeling of the reservoir), and the modeling is used to generate a simulation of the reservoir. Such a simulation may, for example, be used as a basis for developing the reservoir.

FIG. 1 is a diagram that illustrates a well environment 100 in accordance with one or more embodiments. In the illustrated embodiment, the well environment 100 includes a reservoir ("reservoir") 102 located in a subsurface formation ("formation") 104 and a well system ("well") 106.

The formation 104 may include a porous or fractured rock formation that resides beneath the earth's surface (or "surface") 108. The reservoir 102 may be a hydrocarbon reservoir defined by a portion of the formation 104 that contains (or that is at least determined or expected to contain) a subsurface pool of hydrocarbons, such as oil and gas. The formation 104 and the reservoir 102 may each include layers of rock having varying characteristics, such as varying degrees of permeability, porosity and fluid saturation. The formation 104 may include natural fractures 107 (e.g., fractures created by naturally occurring stress and formation movement) or induced fractures 109 (e.g., fractures generated by hydraulic fracturing or similar stimulation operations).

In the illustrated embodiment, the well 106 includes a wellbore 120, a production system 122, and a well control system ("control system") 124. The wellbore 120 is defined by a bored hole that extends from the surface 108 into a target zone of the formation 104, such as the reservoir 102. The wellbore 120 may be created, for example, by a drill bit of a drilling system of the well 106 boring through the formation 104 and the reservoir 102. An upper end of the wellbore 120 (e.g., located at or near the surface 108) may be referred to as the "up-hole" end of the wellbore 120. A lower end of the wellbore 120 (e.g., terminating in the formation 104) may be referred to as the "down-hole" end of the wellbore 120. In the case of the well 106 being operated as a production well, the well 106 may be a hydrocarbon production well that is operable to facilitate the extraction of hydrocarbons (or "production") from the reservoir 102. In the case of the well 106 being operated as an injection well, the well 106 may be a water or gas injection well that is operable to facilitate the injection of water or gas into the formation 104 (or "fracking") to generate the induced fractures 109.

In some embodiments, the production system 122 includes devices that facilitate that extraction of production from the reservoir 102 by way of the wellbore 120. For example, the production system 122 may include valves, pumps and sensors that are operable to regulate the flow of production from the wellbore 120 and to monitor production parameters (e.g., production flow rate, temperature, and pressure).

In some embodiments, the well control system 124 is operable to control various operations of the well 106, such as well drilling operations, well completion operations, well production operations, or well or formation remediation operations. For example, the well control system 124 may include a well system memory and a well system processor that are capable of performing the various processing and control operations of the well control system 124 described here. In some embodiments, the well control system 124 includes a computer system that is the same as or similar to that of computer system 1000 described with regard to at least FIG. 7.

In some embodiments, the well control system 124 is operable to determine and employ constrained fracture model parameter ranges. This may include, for example, the well control system 124 performing the following operations: (1) determining a natural fracture model 130 of the hydrocarbon reservoir 102; (2) determining initial ranges of a plurality of fracture modeling parameters 132 of the natural fracture model 130 (e.g., determining initial ranges for fracture intensity, fracture length, fracture aspect ratio, fracture concentration, in-situ stresses, friction angle, and a fracture permeability factor of the natural fracture model 130); (3) determining a geological modeling 134 of the hydrocarbon reservoir 102 for generating a modeled flow capacity for the well 106 (e.g., a modeled flow capacity that is dependent on the fracture modeling parameters); (4) determining an observed well flow capacity for the well (e.g., based on observed well production test data 136, such as production log test (PLT) data and pressure transient analysis (PTA) data); and (5) conducting a natural fracture model optimization (e.g., an optimization employing a genetic algorithm to minimize differences between the observed and modeled well flow capacities) to determine constrained fracture model parameters 138 including a constrained range (e.g., defined by a maximum and minimum) for each fracture modeling parameter of the plurality of fracture modeling parameters 132. In some embodiments, the minimization operation includes a minimization of differences between the observed well flow capacity and the modeled flow capacity. For example, the minimization operation may include application of a genetic algorithm to identify a set of "optimal" fracture model parameters that include constrained fracture model parameters 138, defined maximum and minimum values of some or all of the fracture model parameters of the set of optimal fracture model parameters.

In some embodiments, the well control system 124 conducts a simulation of the hydrocarbon reservoir that employs the "constrained" natural fracture model 130 (e.g., the natural fracture model 130 including the constrained fracture model parameters 138) to generate a reservoir simulation 140 that includes a prediction of performance of the hydrocarbon reservoir 102 (e.g., hydrocarbon production estimates for the well 106). In some embodiments, the simulation is a simultaneous closed-loop inversion in dual porosity dual permeability numerical simulation, such as that described in U.S. Patent Publication No. 2020/0292722 titled "Method for Dynamic Calibration and Simultaneous Closed-Loop Inversion of Simulation Models of Fractured Reservoirs" by Maucec, et al., which is hereby incorporated by reference.

In some embodiments, the well control system 124 determines well parameters 142 for the well 106 based on the reservoir simulation 140, and the well 106 is developed in accordance with the well parameters 132. The well parameters 142 may include, for example, a well location and a wellbore trajectory. In such an instance, operating the well 106 may include the well control system 124 (or another operator) controlling a drilling system to drill the wellbore 120 of the well 106 at the location and trajectory. As a further example, the well parameters 142 may include a production pressure or production rate, and operating the well 106 may include the well control system 124 (or another operator) controlling the production system 122 of the well 106 to operate the well 106 at the production pressure or production rate.

Figure 2:
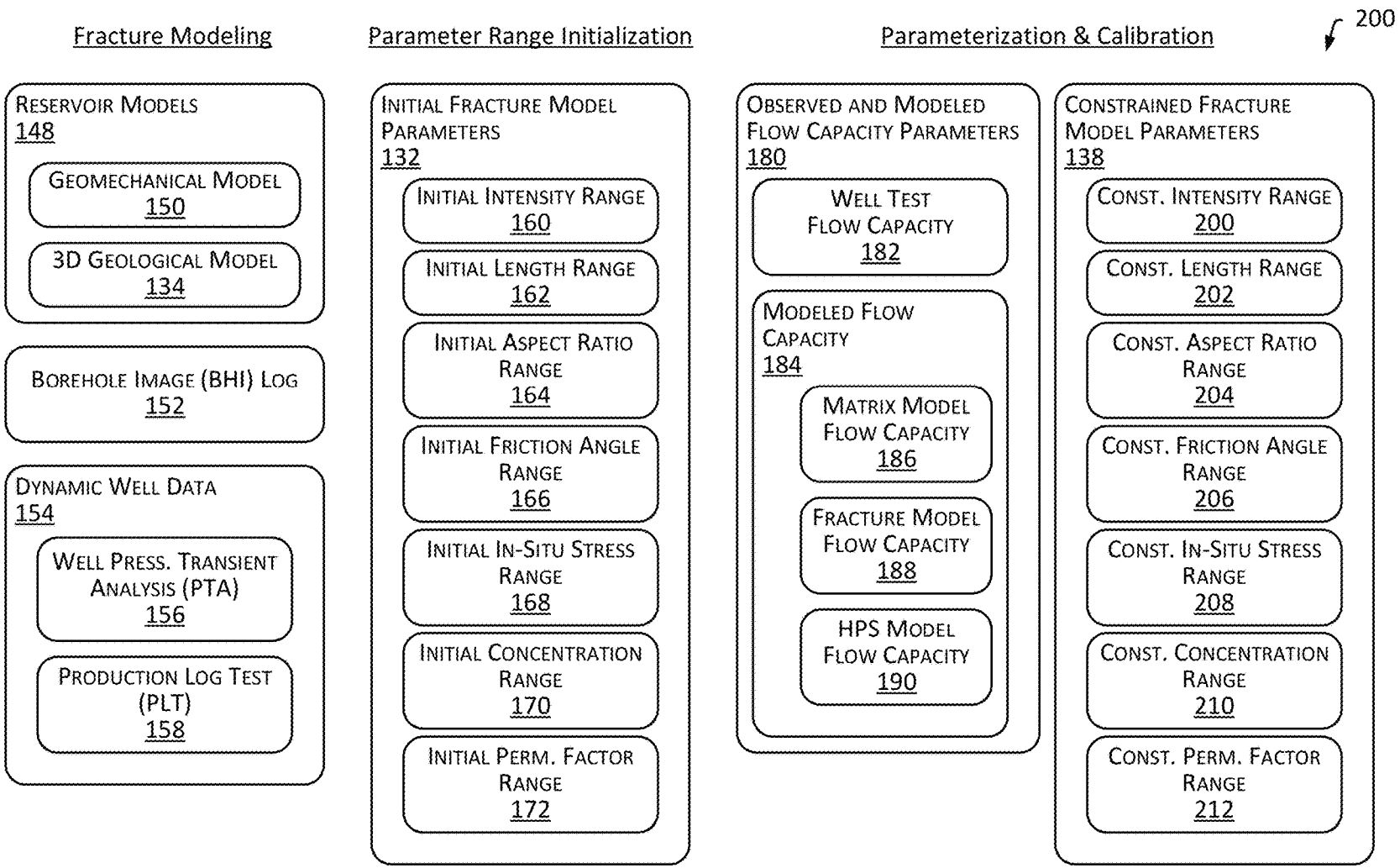
FIG. 2 is a flow diagram that illustrates a process of constraining fracture model parameter ranges in accordance with one or more embodiments.

FIG. 2 is a flow diagram that illustrates constraining fracture model parameter ranges in accordance with one or more embodiments. In some embodiments, a fracture modeling stage includes defining reservoir models 148 of the reservoir 102, including a geomechanical model 150 and a three dimensional (3D) geological model 134 of the reservoir 102, and obtaining a borehole image (BHI) log 152 and dynamic well data 145 for one or more wells extending into the reservoir 102 (e.g., for well 106). The dynamic well data 145 including well pressure transient analyses (PTAs) 156 and production log tests (PLTs) for the well(s).

In some embodiments, a parameter range initialization stage includes determining initial fracture model parameters 132 based on the elements defined and obtained in the fracture modeling stage. The initial fracture model parameters 132 may include an "initial" range (e.g., defined by a maximum and minimum value) for each of the fracture model parameters 132, including, for example, an initial fracture intensity parameter range 160 (e.g., range of volumetric fracture density, expressed as the area of fractures per unit volume of a fracture set being modeled), an initial fracture length parameter range 162 (e.g., range of length of fractures of the set), an initial fracture aspect ratio parameter range 164 (e.g., a range of the ratio of fracture length to width of the set), an initial fracture friction angle range 166 (e.g., a range of the friction angles of the set), an initial in-situ stress range 168 (e.g., ranges of the variogram major (max), the variogram minor (min) and the variogram vertical of the formation rock, which are indicative of ranges of the max and minimum horizontal stresses and the vertical stresses, respectively, of the formation rock), an initial fracture concentration parameter range 170 (e.g., a range of aperture distribution for the set), and an initial permeability factor range 172.

In some embodiments, the initial fracture friction angle range 166 and the initial in-situ stress range 168 are determined using the geomechanical model 150. The geomechanical model 150 may include including modeling of various mechanical characteristics of the reservoir 102, such as a brittleness modeled using a neuronal network classification, a paleo-stress analysis modeling fracture folding (e.g., using geomechanical restoration (e.g., using Kine 3D provided by Emerson E&P Software of Houston, Tex.) and faulting response modeled using boundary element method (BEM) (e.g., using Petrel software by Schlumberger of Houston, Tex.)), an in-situ stress regime modeling using finite element method (FEM) to predict stress/strain tensor regime using mechanical boundary elements, and a critical stress concept criteria to assess in-situ stress orientation and magnitude (e.g., following Mohr Coulomb criteria). The initial fracture friction angle range 166 and the initial in-situ stress range 168 may be determined from corresponding maximum and minimum values for each, provided by the geomechanical model 150. In some embodiments, the initial fracture friction angle range 166 is determined to at or about 0.6.

In some embodiments, the initial fracture intensity parameter range 160, the initial fracture length parameter range 162, the initial fracture aspect ratio parameter range 164, and the initial fracture concentration parameter range 170 are determined based on assessment of the borehole image (BHI) log 152. The initial ranges of each may be determined from corresponding maximum and minimum values for each, provided by assessment of the borehole image (BHI) log 152. The initial fracture intensity parameter range 160 may be determined, for example, by way of a P32 intensity model of the borehole image (BHI) log 152.

In some embodiments, the permeability factor is a coefficient that is applied to provide for adjustment of the overall permeability, in effort to account for variations due to stress and other factors. The initial permeability factor range 172 may, for example, be a predefined range based on permeability factors historically used for similarly situated formation rock, such as other rock found in or near the formation 104.

In some embodiments, a parameterization and calibration stage includes employing an optimization based on comparisons of observed and modeled flow capacity parameters 180. This may include conducting an optimization to minimize differences between an observed (or "well test") flow capacity 182 and modeled flow capacities 184. An observed flow capacity 182 may be a flow capacity determined based on historical well test data, such as the PLTs 158 and the PTAs 156 for one or more wells in the formation 104 (e.g., for well 106). A modeled flow capacity 184 may be an estimated flow capacity generated using the geological model 134 for a given set of fracture model parameters 132. In some embodiments, the modeled flow capacity 184 is a sum of a matrix model flow capacity 186, a fracture model flow capacity 188 and a HPS model flow capacity 190. During the parameterization and calibration stage a natural fracture model optimization may be conducted that includes, for each of different sets of fracture model parameters falling within the ranges of the initial fracture model parameters 132, applying the set of fracture model parameters to the geological modeling 134 to generate a corresponding modeled flow capacity 184, and conducting a minimization operation based on a comparison of the modeled flow capacities 184 to observed flow capacities 182, to determine constrained fracture model parameters 138. The constrained fracture model parameters 138 may include a "constrained" range (e.g., defined by a maximum and minimum value) for each of the fracture model parameters 132, including, for example, a constrained fracture intensity parameter range 200, a constrained fracture length parameter range 202, a constrained fracture aspect ratio (e.g., fracture length/with) parameter range 204, a constrained fracture friction angle range 206, a constrained in-situ stress range 208, a constrained fracture concentration (e.g., aperture distribution) parameter range 210, and a constrained permeability factor range 212. In some embodiments, the minimization operation includes a comparison of the modeled flow capacities to one or more of the observed well flow capacities. For example, the minimization operation may include a minimization of observed and modeled flow capacities for one or more wells, according to the following equation:

$$O.F. = \text{Minimize}\left(\sum_{i=1}^{n} |(KH_{PTA(i)} - KH_{Matrix(i)} - KH_{Fracture(i)} - KH_{HPS(i)})|\right), \quad (1)$$

where:

$KH_{PTA(i)}$ is an "observed" well flow capacity flow capacity determined from well test for the well i $KH_{Matrix(i)}$ is a flow capacity from a matrix model for the well i, $KH_{Fracture(i)}$ is a flow capacity from a fracture model for the well i, $KH_{HPS(i)}$ is a flow capacity from HPS (High Permeability Streaks) model for the well i.

Figure 3:
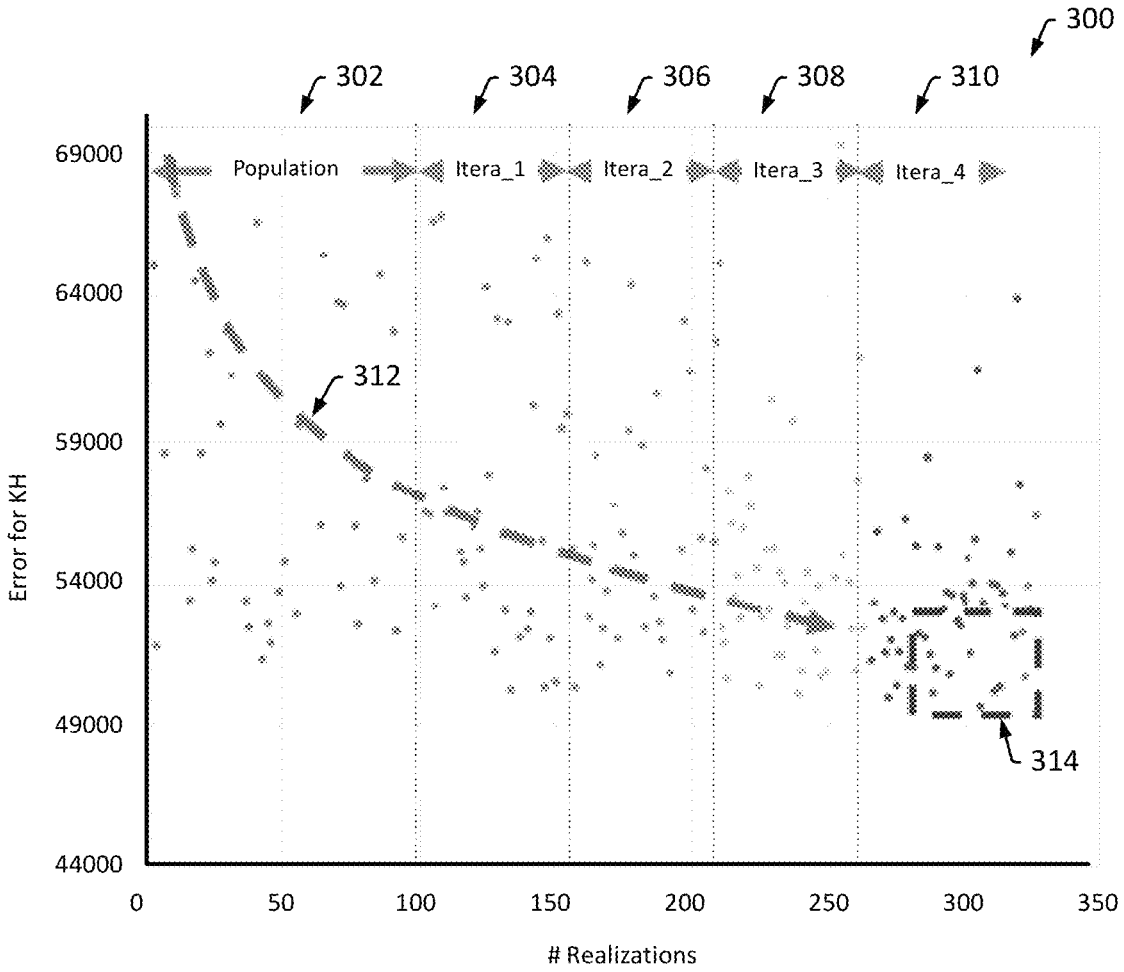
FIG. 3 is a diagram that illustrates example error data in accordance with one or more embodiments.

In some embodiments, the minimization operation includes application of a genetic algorithm (e.g., using the above equation) to identify a set of optimal fracture model parameters. Such a genetic algorithm based minimization operation may include generating a set of error values for sets of fracture model parameters falling within the initial fracture model parameter ranges, and iteratively reducing (or "narrowing") some or all of the fracture model parameter ranges until the error is reduced to a sufficient degree, and generating constrained fracture model parameters 132 having ranges that correspond to the "reduced" ranges associated with the reduced error. FIG. 3 is a plot 300 that illustrated iterative reduction of error values (e.g., using a genetic algorithm based on equation 1) to identify a subset of parameter values 314 that are used to define constrained fracture model parameters 132. The "population" portion 302 of the plot 300 illustrates example error values for respective sets of initial fracture model parameters 132. The "first" through "fourth" iteration portions of the plot 304-310, illustrate example error values for respective sets of fracture model parameters 132 of iteratively "reduced" fracture model parameter ranges identified in first, second, third, and fourth iterations, respectively, of the application of a genetic algorithm using equation 1. Notably, with the fourth iteration, the error values have been minimized (e.g., the net error is determined to be below a threshold or the change in error from the prior iteration is determined to be below a threshold). In some embodiments, a cluster of representative error values 314 is selected (e.g., using a known clustering technique, such a K-means clustering), and the maximum and minimum parameter values associated with the selected error values are used to define the maximum and minimum values of the associated constrained fracture model parameters 132.

FIG. 4 is a diagram that illustrates example parameter sets 400 associated with a selected set of representative error values 314 in accordance with one or more embodiments. FIG. 5 is a diagram that illustrates example constrained parameter ranges 500 (corresponding to the parameter sets 400 of FIG. 4) in accordance with one or more embodiments. Thus for example, a constrained fracture length parameter range 202 may be determined to be 3688.29 to 4597.77 based on the maximum and minimum values of fracture length in the parameter sets 400 (see bolded values of FIG. 4). Ranges may be similarly defined for each of some or all of the other parameters associated with the parameter sets 400, as shown in the constrained parameter ranges 500 FIG. 5.

In some embodiments the constrained parameter ranges (e.g., constrained parameter ranges 138) are used as a basis for modeling the reservoir 102. For example, the constrained parameter ranges 500 may be used in a simultaneous closed loop inversion of the natural fracture modeling of the reservoir) which provides inputs to the geological model 134 used to generate a corresponding reservoir simulation 140 of the reservoir 104. Such a simulation 140 may, for example, be used as a basis for developing the reservoir 102. For example, the results of the simulation 140 may be used to develop a field development plan (FDP) for the reservoir 102 that defines a drilling location and a wellbore trajectory for each of one or more wells in the reservoir 102 or operating parameters (e.g., specified production rates or pressures) for each of one or more wells in the reservoir 102. The one or more wells may be drilled at the associated location and with the associated wellbore trajectory, or the one or more wells may be operated in accordance with the operating parameters (e.g., some or all of the wells may be operated at a specified production rate or pressure defined for the well, in the FDP).

Figure 6:
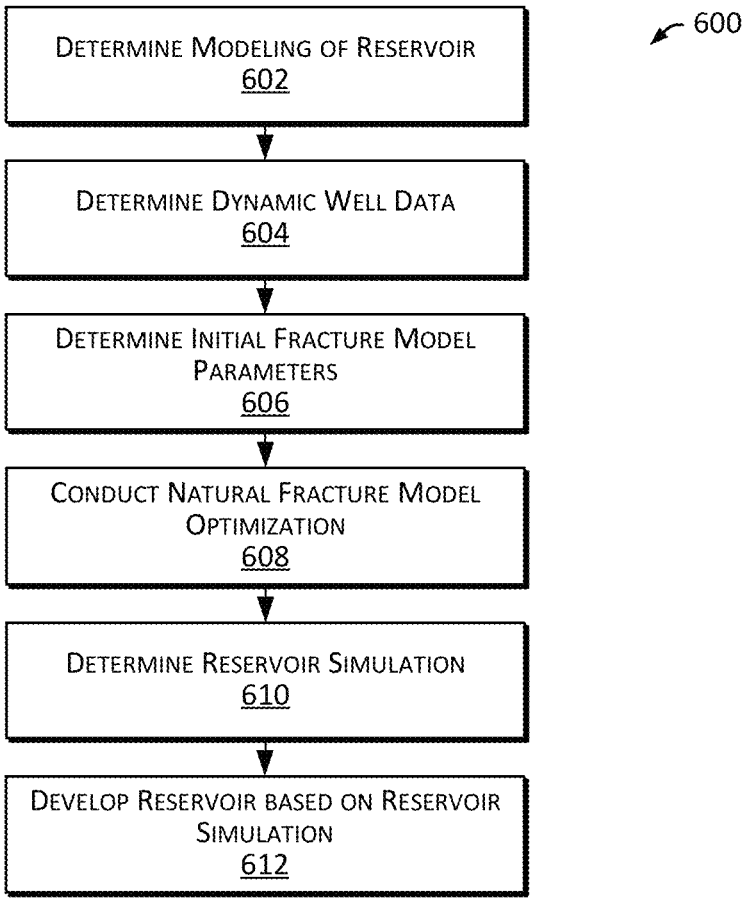
FIG. 6 is a flow chart diagram that illustrates a method of developing a reservoir in accordance with one or more embodiments.

FIG. 6 is a flowchart that illustrates a method 600 of determining constrained natural fracture parameters, and developing a hydrocarbon reservoir based on the constrained natural fracture parameters, in accordance with one or more embodiments. In the context of the well 106, some or all of the operations of method 600 may be performed by the well control system 124 (or another operator of the well 106).

In some embodiments, method 600 includes determining modeling of a reservoir (block 602) and determining dynamic well data for the reservoir (block 604). This may include determining a natural fracture modeling and a geological modeling of a reservoir, and obtaining dynamic well data, such as PTAs and PLTs for one or more wells in the reservoir. For example, this may include the well control system 124 (or another operator of the well 106) determining the reservoir models 148, including the geomechanical model 150 and the geological model 134 of the reservoir 102, and obtaining dynamic well data 154, including PTAs 156 and PLTs 158 for one or more wells in the reservoir 102.

In some embodiments, method 600 includes determining initial fracture model parameters (block 606). This may include determining initial fracture model parameters, including an "initial" range for each of the fracture model parameters. For example, this may include the well control system 124 (or another operator of the well 106) determining the initial fracture model parameters 132, including an "initial" range (e.g., defined by a maximum and minimum value) for each of the fracture model parameters 132.

In some embodiments, method 600 includes conducting natural fracture model optimization (block 608). This may include a parameterization and calibration (e.g., employing Genetic algorithm) to determine an "optimized" set of fracture model parameters, including constrained ranges for the fracture model parameters. For example, this may include the well control system 124 (or another operator of the well 106) conducting a parameterization and calibration employing a genetic algorithm to determine a constrained set of fracture model parameters 138, including constrained ranges for the fracture model parameters (e.g., including a constrained fracture length parameter range 202 of 3688.29 to 4597.77).

In some embodiments, method 600 includes determining a reservoir simulation based on the natural fracture model optimization (block 610). This may include determining a reservoir simulation using the "optimized" set of fracture model parameters. For example, this may include the well control system 124 (or another operator of the well 106) determining a reservoir simulation 140 using the "optimized" set of fracture model parameters 138.

In some embodiments, method 600 includes developing the reservoir based on the reservoir simulation (block 612). This may include determining a FDP for the reservoir based on the reservoir simulation, and developing the reservoir based on the FDP. For example, this may include the well control system 124 (or another operator of the well 106) using the results of the simulation 140 to develop a field development plan (FDP) for the reservoir 102 with well parameters 142 that define a drilling location and a wellbore trajectory for each of one or more wells in the reservoir 102 or operating parameters (e.g., specified production rates or pressures) for each of one or more wells in the reservoir 102, and controlling a drilling system to drill each of one or more of the wells at a location and with an associated wellbore trajectory (e.g., to create the well in accordance with a location and trajectory defined for the well, in the FDP), or controlling a production system of each of the one or more wells to operate the well in accordance with the operating parameters (e.g., to operate the well at a production rate or pressure defined for the well, in the FDP).

Figure 7:
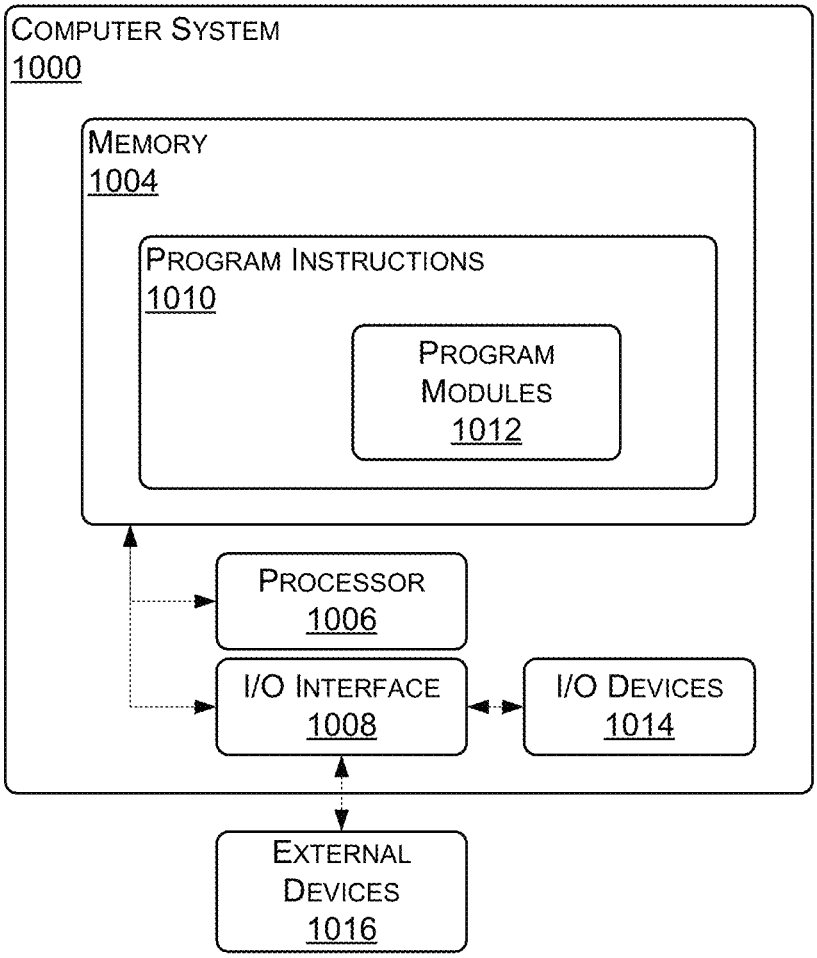
FIG. 7 is a diagram that illustrates an example computer system in accordance with one or more embodiments.

FIG. 7 is a diagram that illustrates an example computer system (or "system") 1000 in accordance with one or more embodiments. In some embodiments, the system 1000 is a programmable logic controller (PLC). The system 1000 may include a memory 1004, a processor 1006 and an input/output (I/O) interface 1008. The memory 1004 may include non-volatile memory (for example, flash memory, read-only memory (ROM), programmable read-only memory (PROM), erasable programmable read-only memory (EPROM), electrically erasable programmable read-only memory (EEPROM)), volatile memory (for example, random access memory (RAM), static random access memory (SRAM), synchronous dynamic RAM (SDRAM)), or bulk storage memory (for example, CD-ROM or DVD-ROM, hard drives). The memory 1004 may include a non-transitory computer-readable storage medium having program instructions 1010 stored thereon. The program instructions 1010 may include program modules 1012 that are executable by a computer processor (for example, the processor 1006) to cause the functional operations described, such as those described with regard to the well control system 124 (or another operator of the well 106), the process 200, or the method 600.

The processor 1006 may be any suitable processor capable of executing program instructions. The processor 1006 may include a central processing unit (CPU) that carries out program instructions (for example, the program instructions of the program modules 1012) to perform the arithmetical, logical, or input/output operations described. The processor 1006 may include one or more processors. The I/O interface 1008 may provide an interface for communication with one or more I/O devices 1014, such as a joystick, a computer mouse, a keyboard, or a display screen (for example, an electronic display for displaying a graphical user interface (GUI)). The I/O devices 1014 may include one or more of the user input devices. The I/O devices 1014 may be connected to the I/O interface 1008 by way of a wired connection (for example, an Industrial Ethernet connection) or a wireless connection (for example, a Wi-Fi connection). The I/O interface 1008 may provide an interface for communication with one or more external devices 1016. In some embodiments, the I/O interface 1008 includes one or both of an antenna and a transceiver. The external devices 1016 may include, for example, devices of the production system 122.

Further modifications and alternative embodiments of various aspects of the disclosure will be apparent to those skilled in the art in view of this description. Accordingly, this description is to be construed as illustrative only and is for the purpose of teaching those skilled in the art the general manner of carrying out the embodiments. It is to be understood that the forms of the embodiments shown and described here are to be taken as examples of embodiments. Elements and materials may be substituted for those illustrated and described here, parts and processes may be reversed or omitted, and certain features of the embodiments may be utilized independently, all as would be apparent to one skilled in the art after having the benefit of this description of the embodiments. Changes may be made in the elements described here without departing from the spirit and scope of the embodiments as described in the following claims. Headings used here are for organizational purposes only and are not meant to be used to limit the scope of the description.

It will be appreciated that the processes and methods described here are example embodiments of processes and methods that may be employed in accordance with the techniques described here. The processes and methods may be modified to facilitate variations of their implementation and use. The order of the processes and methods and the operations provided may be changed, and various elements may be added, reordered, combined, omitted, modified, and so forth. Portions of the processes and methods may be implemented in software, hardware, or a combination of software and hardware. Some or all of the portions of the processes and methods may be implemented by one or more of the processors/modules/applications described here.

As used throughout this application, the word "may" is used in a permissive sense (that is, meaning having the potential to), rather than the mandatory sense (that is, meaning must). The words "include," "including," and "includes" mean including, but not limited to. As used throughout this application, the singular forms "a", "an," and "the" include plural referents unless the content clearly indicates otherwise. Thus, for example, reference to "an element" may include a combination of two or more elements. As used throughout this application, the term "or" is used in an inclusive sense, unless indicated otherwise. That is, a description of an element including A or B may refer to the element including one or both of A and B. As used throughout this application, the phrase "based on" does not limit the associated operation to being solely based on a particular item. Thus, for example, processing "based on" data A may include processing based at least in part on data A and based at least in part on data B, unless the content clearly indicates otherwise. As used throughout this application, the term "from" does not limit the associated operation to being directly from. Thus, for example, receiving an item "from" an entity may include receiving an item directly from the entity or indirectly from the entity (for example, by way of an intermediary entity). Unless specifically stated otherwise, as apparent from the discussion, it is appreciated that throughout this specification discussions utilizing terms such as "processing," "computing," "calculating," "determining," or the like refer to actions or processes of a specific apparatus, such as a special purpose computer or a similar special purpose electronic processing/computing device. In the context of this specification, a special purpose computer or a similar special purpose electronic processing/computing device is capable of manipulating or transforming signals, typically represented as physical, electronic or magnetic quantities within memories, registers, or other information storage devices, transmission devices, or display devices of the special purpose computer or similar special purpose electronic processing/computing device.

What is claimed is:

1. A method of developing a hydrocarbon reservoir, the method comprising:

- determining a natural fracture model of the hydrocarbon reservoir;
- determining initial ranges for the plurality of fracture modeling parameters comprising:
  - determining, based on geomechanical modeling of the hydrocarbon reservoir, initial ranges of geomechanical parameters of the hydrocarbon reservoir comprising:
    - an initial range of an in-situ stress parameter for the hydrocarbon reservoir; and
    - an initial range of a friction angle parameter for the hydrocarbon reservoir;
  - determining, based on a borehole image (BHI) log of a wellbore extending into the hydrocarbon reservoir, initial ranges of fracture distribution parameters of the hydrocarbon reservoir comprising:
    - an initial range of a fracture intensity parameter;
    - an initial range of a fracture length parameter;
    - an initial range of a fracture aspect ratio parameter; and
    - an initial range of a fracture concentration parameter;
  - determining an initial range of a fracture permeability factor for the hydrocarbon reservoir;

determining a geological modeling of the hydrocarbon reservoir, the geological modeling of the hydrocarbon reservoir configured to generate, for a given set of fracture modeling parameters, a modeled flow capacity;

determining, based on observed well production test data, an observed well flow capacity;

conducting a natural fracture model optimization comprising:

for each of different sets of fracture model parameters falling within the initial fracture model parameter ranges, applying the set of fracture model parameters to the geological modeling of the hydrocarbon reservoir to generate a corresponding modeled flow capacity; and conducting a minimization operation to determine constrained fracture model parameters ranges, the minimization operation comprising comparison of the modeled flow capacities to the observed well flow capacity and the constrained fracture model parameter ranges comprising a constrained range defined by a maximum and minimum value for each fracture modeling parameter of the plurality of fracture modeling parameters;

conducting, using the constrained fracture model parameters ranges and the natural fracture model, a simulation of the hydrocarbon reservoir to generate a reservoir simulation comprising predicted of performance of the hydrocarbon reservoir;

determining, based on the reservoir simulation, operational parameters for a well extending into the hydrocarbon reservoir; and developing, in response to determining the operational parameters, the well in accordance with the operational parameters for the well.

2. The method of claim 1, wherein the minimization operation comprises minimization of differences between the observed well flow capacity and the modeled flow capacity, and wherein the minimization operation comprises application of a genetic algorithm to identify a set of optimal fracture model parameters, wherein the constrained fracture model parameters ranges comprise maximum and minimum values of the fracture model parameters of the set of optimal fracture model parameters.

3. The method of claim 1, wherein the simulation comprises a simultaneous closed-loop inversion in dual porosity dual permeability numerical simulation.

4. The method of claim 1, wherein the natural fracture model comprising a plurality of fracture modeling parameters characterizing naturally occurring fractures of the hydrocarbon reservoir.

5. The method of claim 1, wherein the modeled flow capacity comprising a sum of the following:

a flow capacity for fractures in the hydrocarbon reservoir;

a flow capacity for high permeability streaks (HPS) in the hydrocarbon reservoir; and a flow capacity for the rock matrix in the hydrocarbon reservoir.

6. The method of claim 1, wherein the observed well production test data comprising production log test (PLT) data and pressure transient analysis (PTA) data.

7. The method of claim 1, wherein the operational parameters for the well comprise a well location and trajectory, and developing the well comprises drilling the well at the location and with the trajectory, or wherein the operational parameters for the well comprise a production pressure or production rate, and developing the well comprises operating the well at the production pressure or the production rate.

8. A hydrocarbon well system comprising:

a well system configured to operate the hydrocarbon well; and a well control system configured to perform the following operations:

determining a natural fracture model of the hydrocarbon reservoir;

determining initial ranges for the plurality of fracture modeling parameters comprising:

determining, based on geomechanical modeling of the hydrocarbon reservoir, initial ranges of geomechanical parameters of the hydrocarbon reservoir comprising:

an initial range of an in-situ stress parameter for the hydrocarbon reservoir; and an initial range of a friction angle parameter for the hydrocarbon reservoir;

determining, based on a borehole image (BHI) log of a wellbore extending into the hydrocarbon reservoir, initial ranges of fracture distribution parameters of the hydrocarbon reservoir comprising:

an initial range of a fracture intensity parameter;

an initial range of a fracture length parameter;

an initial range of a fracture aspect ratio parameter; and an initial range of a fracture concentration parameter;

determining an initial range of a fracture permeability factor for the hydrocarbon reservoir;

determining a geological modeling of the hydrocarbon reservoir, the geological modeling of the hydrocarbon reservoir configured to generate, for a given set of fracture modeling parameters, a modeled flow capacity;

determining, based on observed well production test data, an observed well flow capacity;

conducting a natural fracture model optimization comprising:

for each of different sets of fracture model parameters falling within the initial fracture model parameter ranges, applying the set of fracture model parameters to the geological modeling of the hydrocarbon reservoir to generate a corresponding modeled flow capacity; and conducting a minimization operation to determine constrained fracture model parameters ranges, the minimization operation comprising comparison of the modeled flow capacities to the observed well flow capacity and the constrained fracture model parameter ranges comprising a constrained range defined by a maximum and minimum value for each fracture modeling parameter of the plurality of fracture modeling parameters;

conducting, using the constrained fracture model parameters ranges and the natural fracture model, a simulation of the hydrocarbon reservoir to generate a reservoir simulation comprising predicted of performance of the hydrocarbon reservoir; and determining, based on the reservoir simulation, operational parameters for a well extending into the hydrocarbon reservoir;

controlling, in response to determining the operational parameters, the well system to develop the well in accordance with the operational parameters for the well.

9. The system of claim 8, wherein the minimization operation comprises minimization of differences between the observed well flow capacity and the modeled flow capacity, and wherein the minimization operation comprises application of a genetic algorithm to identify a set of optimal fracture model parameters, wherein the constrained fracture model parameters ranges comprise maximum and minimum values of the fracture model parameters of the set of optimal fracture model parameters.

10. The system of claim 8, wherein the simulation comprises a simultaneous closed-loop inversion in dual porosity dual permeability numerical simulation.

11. The system of claim 8, wherein the natural fracture model comprising a plurality of fracture modeling parameters characterizing naturally occurring fractures of the hydrocarbon reservoir.

12. The system of claim 8, wherein the modeled flow capacity comprising a sum of the following:

a flow capacity for fractures in the hydrocarbon reservoir;

a flow capacity for high permeability streaks (HPS) in the hydrocarbon reservoir; and a flow capacity for the rock matrix in the hydrocarbon reservoir.

13. The system of claim 8, wherein the observed well production test data comprising production log test (PLT) data and pressure transient analysis (PTA) data.

14. The system of claim 8, wherein the operational parameters for the well comprise a well location and trajectory, and developing the well comprises drilling the well at the location and with the trajectory, or wherein the operational parameters for the well comprise a production pressure or production rate, and developing the well comprises operating the well at the production pressure or the production rate.

15. A non-transitory computer readable storage medium comprising program instructions stored thereon that are executable by a processor to perform the following operations for developing a hydrocarbon reservoir:

determining a natural fracture model of the hydrocarbon reservoir;

determining initial ranges for the plurality of fracture modeling parameters comprising:

determining, based on geomechanical modeling of the hydrocarbon reservoir, initial ranges of geomechanical parameters of the hydrocarbon reservoir comprising:

an initial range of an in-situ stress parameter for the hydrocarbon reservoir; and an initial range of a friction angle parameter for the hydrocarbon reservoir;

determining, based on a borehole image (BHI) log of a wellbore extending into the hydrocarbon reservoir, initial ranges of fracture distribution parameters of the hydrocarbon reservoir comprising:

an initial range of a fracture intensity parameter;

an initial range of a fracture length parameter;

an initial range of a fracture aspect ratio parameter; and an initial range of a fracture concentration parameter;

determining an initial range of a fracture permeability factor for the hydrocarbon reservoir;

determining a geological modeling of the hydrocarbon reservoir, the geological modeling of the hydrocarbon reservoir configured to generate, for a given set of fracture modeling parameters, a modeled flow capacity;

determining, based on observed well production test data, an observed well flow capacity;

conducting a natural fracture model optimization comprising:

for each of different sets of fracture model parameters falling within the initial fracture model parameter ranges, applying the set of fracture model parameters to the geological modeling of the hydrocarbon reservoir to generate a corresponding modeled flow capacity; and conducting a minimization operation to determine constrained fracture model parameters ranges, the minimization operation comprising comparison of the modeled flow capacities to the observed well flow capacity and the constrained fracture model parameter ranges comprising a constrained range defined by a maximum and minimum value for each fracture modeling parameter of the plurality of fracture modeling parameters;

conducting, using the constrained fracture model parameters ranges and the natural fracture model, a simulation of the hydrocarbon reservoir to generate a reservoir simulation comprising predicted of performance of the hydrocarbon reservoir; and determining, based on the reservoir simulation, operational parameters for a well extending into the hydrocarbon reservoir;

controlling, in response to determining the operational parameters, a well system to develop the well in accordance with the operational parameters for the well.

16. The medium of claim 15, wherein the minimization operation comprises minimization of differences between the observed well flow capacity and the modeled flow capacity, and wherein the minimization operation comprises application of a genetic algorithm to identify a set of optimal fracture model parameters, wherein the constrained fracture model parameters ranges comprise maximum and minimum values of the fracture model parameters of the set of optimal fracture model parameters.

17. The medium of claim 15, wherein the simulation comprises a simultaneous closed-loop inversion in dual porosity dual permeability numerical simulation.

18. The medium of claim 15, wherein the natural fracture model comprising a plurality of fracture modeling parameters characterizing naturally occurring fractures of the hydrocarbon reservoir.

19. The medium of claim 15, wherein the modeled flow capacity comprising a sum of the following:

a flow capacity for fractures in the hydrocarbon reservoir;

a flow capacity for high permeability streaks (HPS) in the hydrocarbon reservoir; and a flow capacity for the rock matrix in the hydrocarbon reservoir.

20. The medium of claim 15, wherein the observed well production test data comprising production log test (PLT) data and pressure transient analysis (PTA) data.

21. The medium of claim 15, wherein the operational parameters for the well comprise a well location and trajectory, and developing the well comprises drilling the well at the location and with the trajectory, or wherein the operational parameters for the well comprise a production pressure or production rate, and developing the well comprises operating the well at the production pressure or the production rate.

* * * * *